US008661952B2

(12) United States Patent
Arikita et al.

(10) Patent No.: US 8,661,952 B2
(45) Date of Patent: Mar. 4, 2014

(54) CUTTING MACHINE

(75) Inventors: Reiji Arikita, Wakayama (JP); Kenji Ikoma, Wakayama (JP)

(73) Assignee: Shima Seiki Mfg., Ltd., Wakayama-Shi, Wakayama (JP)

( * ) Notice: Subject to any disclaimer, the term of this patent is extended or adjusted under 35 U.S.C. 154(b) by 659 days.

(21) Appl. No.: 12/742,183

(22) PCT Filed: Nov. 7, 2008

(86) PCT No.: PCT/JP2008/003229

§ 371 (c)(1),
(2), (4) Date: May 10, 2010

(87) PCT Pub. No.: WO2009/060622

PCT Pub. Date: May 14, 2009

(65) Prior Publication Data

US 2010/0251868 A1 Oct. 7, 2010

(30) Foreign Application Priority Data

Nov. 9, 2007 (JP) ..... 2007-292645

(51) Int. Cl.
*B26D 7/08* (2006.01)
*B24B 19/16* (2006.01)

(52) U.S. Cl.
USPC ..... 83/174; 83/471; 451/419; 451/321; 451/349

(58) Field of Classification Search
USPC ..... 83/174, 471, 174.1; 451/70, 261, 269, 451/293, 259, 260, 321, 349, 419, 421
See application file for complete search history.

(56) References Cited

U.S. PATENT DOCUMENTS 3,736,825 A * 6/1973 Covell ..... 83/174
4,033,214 A 7/1977 Pearl (Continued)

FOREIGN PATENT DOCUMENTS

DE 2659927 C2 7/1983
JP 45-29672 Y1 11/1970

(Continued)

OTHER PUBLICATIONS

Supplemental European Search Report issued in European Patent Application No. 08848546.1, 4 pages (Aug. 31, 2012).

*Primary Examiner* — Omar Flores Sanchez
(74) *Attorney, Agent, or Firm* — Rothwell, Figg, Ernst & Manbeck PC

(57) ABSTRACT

It is an object of the present invention to provide a cutting machine capable of keeping an angle of a cutting edge constant. A support block 14 is provided with two arms 14*a*, 14*b* which are spaced at a certain angle, and the arms 14*a*, 14*b* have rotation shafts 12*a*, 13*a* of rotary whetstones 12, 13, respectively, extending upright from the vicinities of the front ends thereof. The rotary whetstones 12, 13 has, at front ends thereof, flat surfaces 12*b*, 13*b* perpendicular to the rotation shafts 12*a*, 13*a* to grind the one side 11*b* and the other side 11*c* of the cutting edge 11*a* of the cutting blade 11, respectively. The whetstone holding mechanism 15 can be moved linearly along the guide shaft 16 and can change over grinding states in which the flat surfaces 12*b*, 13*b* of the rotary whetstones 12, 13 into contact with the one side 11*b* or the other side 11*c* of the cutting blade 11. Even when the grinding progresses, since parallelism between the flat surfaces 12*b*, 13*b* and the one side 11*b* and the other side 11*c* of the cutting blade 11, so that the angle of the cutting edge is kept constant.

8 Claims, 15 Drawing Sheets

(56) References Cited

U.S. PATENT DOCUMENTS

| | | | | | |
|---|---|---|---|---|---|
| 4,201,101 | A | * | 5/1980 | Gerber | 83/22 |
| 4,713,950 | A | * | 12/1987 | Mascetti | 69/10 |
| 4,762,040 | A | * | 8/1988 | Alcantara Perez et al. | 83/56 |
| 4,928,432 | A | * | 5/1990 | Yang et al. | 451/70 |
| 5,303,515 | A | * | 4/1994 | Etcheparre et al. | 451/45 |
| 5,573,442 | A | * | 11/1996 | Morita et al. | 451/8 |
| 5,626,065 | A | * | 5/1997 | Cattini | 83/174 |
| 5,667,428 | A | * | 9/1997 | Lunn | 451/70 |
| 6,709,319 | B2 | * | 3/2004 | Yan | 451/70 |
| 6,748,836 | B2 | * | 6/2004 | Vivirito et al. | 83/174 |
| 8,025,554 | B2 | * | 9/2011 | Moriya | 451/8 |

FOREIGN PATENT DOCUMENTS

| | | | |
|---|---|---|---|
| JP | 52-87780 | | 7/1977 |
| JP | 5-57582 | A | 3/1993 |
| JP | 7-136989 | A | 5/1995 |
| JP | 07060692 | A | 7/1995 |
| JP | 3390219 | A | 3/2003 |
| JP | 2004-17444 | A | 1/2004 |
| WO | 2007086338 | A1 | 8/2007 |

* cited by examiner (a)

(b)

(a)

(b)

CUTTING MACHINE

CROSS REFERENCE TO RELATED APPLICATION

This application is a 35 U.S.C. 371 National Phase Entry Application from PCT/JP2008/003229, filed Nov. 7, 2008, which claims the benefit of Japanese Patent Application No. 2007-292645 filed on Nov. 9, 2007, the disclosure of which is incorporated herein in its entirety by reference.

TECHNICAL FIELD

The present invention relates to a cutting machine for cutting a sheet material and the like, and particularly to a cutting machine having the function of grinding a cutting blade.

BACKGROUND ART

In general, to a sheet material such as textile fabric, the cutting is performed to cut it based on a pattern paper or on the data corresponding to the pattern paper. A cutting machine or the like used for the cutting has a grinding function to keep sharpness of a cutting blade (Cf. Patent Citation 1, for example). The Patent Citation 1 discloses a sheet material cutting device for cutting the sheet material with a cutting knife which is moved in reciprocation along a vertical axial line direction and also discloses two different ways of grinding the cutting knife from both sides of its cutting edge.

FIG. 15 shows those two different concepts on the grinding disclosed by Patent Citation 1. FIG. 15(*a*) shows one concept on the grinding with a rounded surface around outside of periphery of a rotary whetstone disclosed in FIG. 11 and the like. FIG. 15(*b*) shows another concept on grinding with a flat surface of the rotary whetstone. The flat surface is perpendicular to the axis of the rotary whetstone, as disclosed in FIG. 13 and the like of the Patent citation 1. In the following, the simplified construction is illustrated, for explanatory convenience. Although names and reference numerals of parts may vary, the correspondence relation to the two different concepts on the grinding should be obvious.

In FIG. 15(*a*), one side 1*b* of the cutting edge 1*a* of the cutting knife 1 and the other side 1*c* of the same are ground with outside surfaces 2*a*, 3*a* of outer peripheries of two rotary whetstones 2, 3, respectively. The two rotary whetstones 2, 3 are supported at front ends of two arms 4*a*, 4*b* of a support block 4. The two arms 4*a*, 4*b* are fixed with spaced apart from each other at a certain angle. The support block 4 is capable of oscillating displacement around a pivot shaft 5 penetrating intermediate portion between the arms 4*a*, 4*b*. The pivot shaft 5 supports the cutting knife 1 so as to be capable of moving in reciprocation along a direction vertical to the paper, and is stuck up from base 6 which turns in conjunction with a direction of the cutting edge 1*a* of the cutting knife 1. When the support block 4 is made oscillating displacement with respect to the pivot shaft 5 in one direction or the other, the one side 1*b* of the cutting knife 1 or the other side 1*c* of the same can be ground with the related outside surface 2*a*, 3*a* of the rotary whetstone 2, 3. In this regard, however, since the grinding is performed using the cylindrical surface 2*a*, 3*a*, even when one side 1*b* and the other side 1*c* of the knife 1 initially have a linear cross-sectional shape, they are varied in cross-section to have a concave surface, as shown as a shaded area.

In FIG. 15(*b*), like reference numerals are labeled to corresponding parts to FIG. 15(*a*), to avoid redundant explanation. The support block 4 has mounting surfaces 4*c*,4*d* on the arms 4*a*,4*b* at the side facing to the cutting edge 1*a* of the cutting knife 1 respectively. The rotary whetstones 2, 3 have rotate shafts perpendicular to the mounting surfaces 4*c*,4*d* and are capable of changing over between grinding states, in which flat surfaces 2*b*,3*b* perpendicular to the rotate shafts are put in contact with the one side 1*b* of the cutting knife 1 or the other side 1*c* of the same to grind it. For example, when the support block 4 is pivotally displaced in one direction with respect to the pivot shaft 5, as showing with the dashed line, the flat surface 2*b* of the rotary whetstone 2 is switched over to the state of being put in contact with the one side 1*b* of the cutting knife 1 to grind it. Likewise, when the support block 4 is pivotally displaced in the other direction with respect to the pivot shaft 5, the flat surface 3*b* of the rotary whetstone 3 is switched over to the state of being put in contact with the other side 1*c* of the cutting knife 1 to grind it. As the cutting knife 1 is ground with the flat surfaces 2*b*, 3*b*, the linear cross-sectional shape of the cutting knife 1 is kept unchanged, as shown as the shaded area.

Such grinding way of FIG. 15(*a*), is not only possible by an overall oscillation displacement of the support block 4, but also possible by putting the cylindrical surfaces 2*a*, 2*b* of the rotary whetstones 2, 3 in contact with the one side 1*b* of the cutting edge 1*a* of the cutting knife 1 or the other side 1*c* of the same, respectively, via a link mechanism and the like (Cf. Patent Citation 2, for example). According to Patent Citation 2, the rotary whetstones 2, 3 and the whetstone supporting structure are contained in the turning cylinder which is turned around an R-axis as a rotation shaft of the cutting edge of the cutting blade corresponding to the cutting knife 1. The switching over between the grinding states is performed by turning the turning cylinder while locking a slide ring mounted on the turning cylinder to be stationary relative to outside. By a relative angular displacement between the slide ring and the turning cylinder, each rotary whetstone pivotally displaces individually via the cams and the link mechanism, thereby allowing the switching over between the grinding states.

Patent Citation 1: JP Patent Publication No. Sho 56-8759
Patent Citation 2: JP Patent No. 3390219

DISCLOSURE OF INVENTION

Technical Problem

As shown in FIG. 15(*a*), when the grind is done by using the cylindrical surfaces 2*a*, 3*a* of the rotary whetstones 2, 3, the one side 1*b* of the cutting edge 1*a* and the other side 1*c* of the same are varied in cross sectional shape to have a concave surface, as shown as the shaded area. In such cross sectional shape, thin wall at its portion close to the cutting edge 1*a* decreases rigidity, while on the other hand, it sharply increases in wall thickness at its portion away from such a thin wall portion in the vicinity of the cutting edge 1*a*, thereby producing an increased cutting resistance. After repeating the grind, the change of the cross sectional shape becomes large.

As shown in FIG. 15(*b*), when the cutting knife is ground using the flat surfaces 2*b*, 3*b* of the rotary whetstones 2, 3, the linear cross sectional shape of the cutting knife may be kept unchanged, as shown as the shaded area. But, since the contact of the flat surfaces 2*b*, 3*b* is caused by the oscillating displacement about the pivot shaft 5, when the grinding is repeated, both the one side 1*b* and the other side 1*c* vary in tilting angle, so that the cutting edge angle decreases and the rigidity decreases. If it is assumed that an angular displacement of θ° around the pivot shaft 5 is provided for the dashed line grinding state of the one side 1*b*, then an angular displacement of −θ° around the pivot shaft 5 is required for the grinding state of the other side 1*c*. Assuming a cutting edge angle formed between the one side 1*b* and the other side 1*c* which are converged at the cutting edge 1*a* is set ψ°, it follows that an angle of the space between the flat surfaces 2*b*, 3*b* is 2×θ°+ψ°. This means that the rotary whetstones 2, 3 have to be supported by the support block 4, with their flat surfaces 2*b*, 3*b* spaced at an angle of 2×θ°+ψ°, and the support block 4 must be pivoted about the pivot shaft 5 at an angle of at least ±θ°.

It might be impossible to contain such construction for grinding with the flat surfaces 2*b*, 3*b* requiring a large space within the turning cylinder as is disclosed in Patent Citation 2. Even if the grinding with the flat surfaces 2*b*, 3*b* of the rotary whetstones 2, 3 is tried to be performed using the mechanism as disclosed in Patent Citation 2, since the angle at which the flat surfaces 2*b*, 3*b* are put in contact with the one side 1*b* and the other side 1*c* of the cutting edge 1*a* by the oscillating displacement varies with the progress of the grinding, it might be impossible to keep the angle of the cutting edge.

It is an object of the present invention to provide a cutting machine capable of grinding in such a manner as to keep an angle of the cutting edge constant.

Technical Solution

The present invention provides a cutting machine for cutting a sheet material to be cut, which is put on a cutting table, with a cutting blade provided in a cutting head movable along the cutting table, wherein the cutting blade is used while both sides of its cutting edge are ground to keep sharpness of the cutting edge, and the cutting head is provided with:

a one side use abrasive whetstone having an abrasive surface to contact and to grind one side of the cutting edge of the cutting blade, an other side use abrasive whetstone having an abrasive surface to contact and to grind the other side of the cutting edge of the cutting blade, and a whetstone holding mechanism that holds abrasive surfaces, with which the one side use abrasive whetstone and the other side use abrasive whetstone grind the cutting blade, leaving a space between the surfaces and being parallel to states, in which the abrasive surfaces of the one side use abrasive whetstone and the other side use abrasive whetstone are sharpened respectively, a guide shaft, penetrated into the whetstone holding mechanism, for guiding it linearly, and a change over mechanism for moving the whetstone holding mechanism along the guide shaft, and for changing over between a standby state and a one side grinding state or an other side grinding state, in the standby state the abrasive surfaces of the one side use abrasive whetstone and the other side use abrasive whetstone being away from both sides of the cutting edge, in the one side grinding state the abrasive surface of the one side use abrasive whetstone being put in contact with the one side of the cutting edge, in the other side grinding state the abrasive surface of the other side use abrasive whetstone being put in contact with the other side of the cutting edge.

In the cutting machine according to the present invention, wherein said cutting head comprises:

a turning cylinder for containing the cutting blade and being capable of turning around a rotate shaft of the cutting edge perpendicular to a surface of the cutting table, to change a cutting direction of the cutting blade;

a slide ring provided on the outside of the turning cylinder and capable of following its turning direction; and a lock mechanism provided at a radial outside of the turning cylinder so as to lock the slide ring to the cutting head;

said change over mechanism and said whetstone holding mechanism are contained in the turning cylinder to allow the selective switch over between the standby state, and the one side grinding state or the other side grinding state according to a turning angle of the turning cylinder around the rotate shaft of the cutting edge when the slide ring is locked by the lock mechanism.

In the cutting machine according to the present invention, wherein said turning cylinder is provided with a rotation ring, which being capable of receiving rotary drive from outside and having inner teeth on the inside of the periphery, said whetstone holding mechanism is provided with a gear engaging with the inner teeth of the rotation ring, the whetstone holding mechanism is capable of oscillating displacement around the guide shaft so as to keep engagement between the gear and the inner teeth of the rotation ring during said movement along the guide shaft, and said one side use abrasive whetstone and said other side use abrasive whetstone rotate by the rotary drive which transmitted to the gear through the rotation ring from outside of the turning cylinder and grind said cutting blade.

In the cutting machine according to the present invention, wherein said slide ring having teeth of a uniform pitch on the outside periphery, said lock mechanism including, a brake provided with inner teeth separated by shifted phase into a plurality steps on the periphery, and biased by spring so as to have different projection amounts at every step, and a drive actuator drives the brake so as to advance and retreat inward of the turning cylinder, and locks the slide ring by putting the inner teeth in contact with the teeth of the slide ring so as to engage when the brake advances.

Advantageous Effects

According to the present invention, the whetstone holding mechanism, provided in the cutting head, holds the abrasive surfaces, to carry out grinding, of the one side use abrasive whetstone and the flat abrasive surface of the other side use abrasive whetstone in parallel to the one side of the cutting blade or the other side of the same, respectively. Since the whetstone holding mechanism, with the movement along the guide shaft caused by the change over mechanism, changes over between the standby state, in which each abrasive surface is away from both of the one side of the cutting edge, and the one side grinding state, in which the one side of the cutting edge is ground, or the other side grinding state, in which the other side of the cutting edge, the grinding can be carried out in such a manner as to keep an angle of the cutting edge constant.

According to the present invention, the structure for grinding the cutting blade and the structure for changing over grinding states are contained in the turning cylinder capable of turning around the rotate shaft of the cutting edge, and the selective switch over between the grinding states can be made at a rotation angle of the turning cylinder in the state in which the slide ring is locked by the lock mechanism.

According to the present invention, while the whetstone holding mechanism moves along the guide shaft in the turning cylinder so as to change over between the grinding states, the whetstone holding mechanism makes an oscillating displacement around the guide shaft. In the whetstone holding mechanism, the gear is provided to receive rotary drive force from outside via the inner teeth of the rotation ring. Though the whetstone holding mechanism makes linear movement along the guide shaft, by the oscillation movement around the guide shaft, the engaging relation between the gear and the inner teeth of the rotation ring is kept. The one side use abrasive whetstone and the other side use abrasive whetstone, which are held by the whetstone holding mechanism, are moved linearly while the state in which the angle between the flat surfaces for grinding consists with the cutting edge angle is kept, so that the rotary drive to the abrasive whetstone continues smoothly during the change over the side for grinding the cutting edge.

According to the present invention, the lock, mechanism is capable of locking the slide ring certainly because of engaging between the outer teeth of the slide ring and the inner teeth of the brake. The inner teeth of the brake are provided with in a state separated into a plurality steps and shifted in phase, and are biased by spring so as to have different projection amount at every step, so that the locking accuracy can be improved.

EXPLANATION OF REFERENCE

Figure 1:
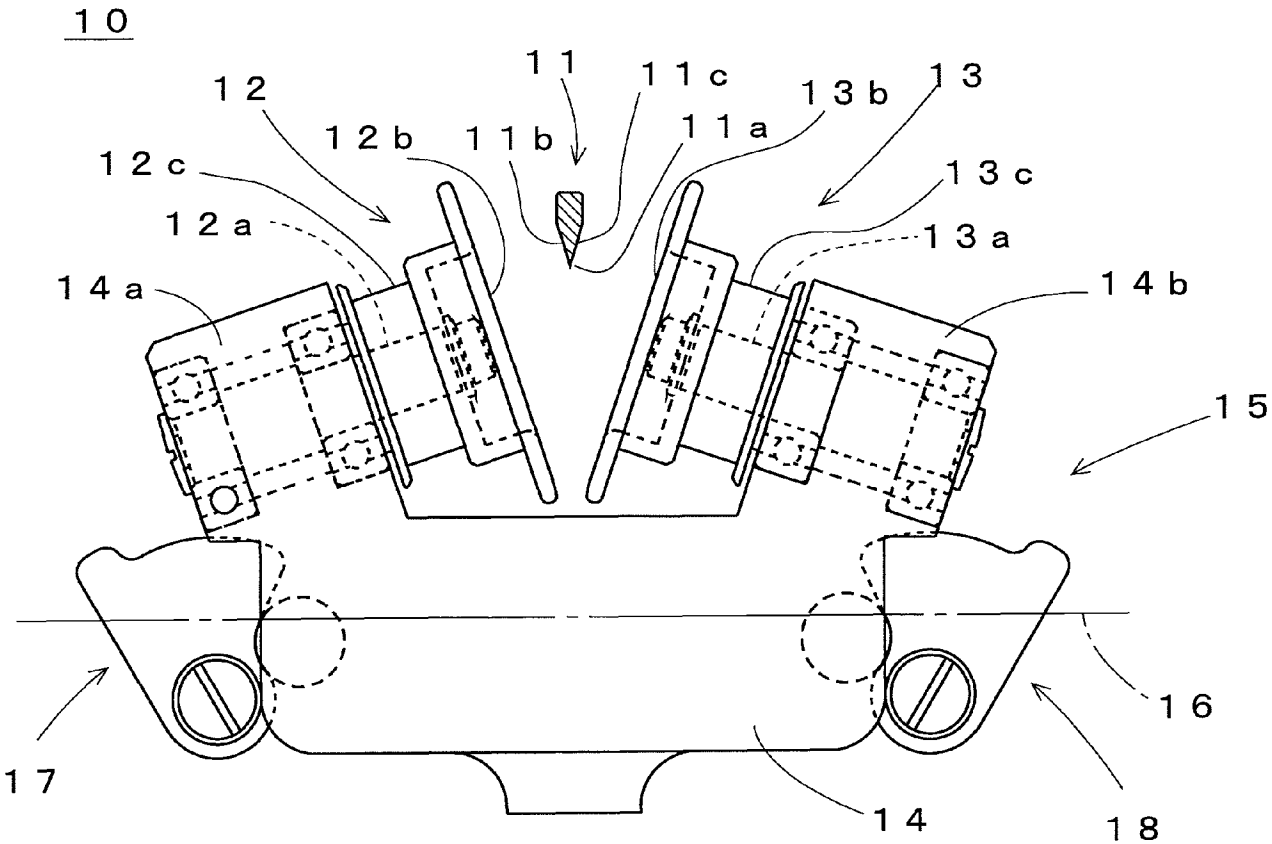
FIG. 1 shows a partial sectional bottom view of a cutting machine 10 as an embodiment of the present invention, simplistically showing a structure for grinding a cutting blade 11.

10 Cutting machine
11 Cutting blade
11*a* Cutting edge
11*b* One side
11*c* Other side
12, 13 Rotary whetstone
12*b*, 13*b* Flat surface
14 Support block
15 Whetstone holding mechanism
16 Guide shaft
17,18 Change over mechanism
20 Cutting head
21 Turning cylinder
21*a* Leg
22 Slide ring
22*a* Outer teeth
23 Lock mechanism
24 Rotation ring
25 Knife guide
28 Support frame
33 Gear
35,45,46 Follower
36 Cam groove
37 Support platform
41, 42, 51, 52 Pivot shaft
43, 44 Pivoted cam
49, 50 Lever
53 Projecting portion
61 Air cylinder
62 Lower step tooth
63 Upper step tooth

BEST MODE FOR CARRYING OUT THE INVENTION

FIG. 1 shows a bottom view of a cutting machine 10 as an embodiment of the present invention, simplistically showing primary elements for grinding a cutting blade 11. The cutting blade 11 has a pentagonal cross sectional shape in which a cutting edge 11*a* is formed by one tilted side surface 11*b* and the other tilted side surface 11*c* being joined together at their tips. The cutting blade 11 is driven to move in reciprocation in a direction perpendicular to paper so as to cut a sheet material to a direction for the cutting edge 11*a* to point. A cutting head including a mechanism to support and drive the cutting blade 11 is moved in parallel with and over a cutting table on which the sheet material is supported so that the sheet material can be cut with the cutting edge 11*a* shifted in position or changed in direction to point.

The cutting head is provided therein with a whetstone holding mechanism 15, placed in front of the cutting edge 11*a* of the cutting blade 11, for holding a pair of rotary whetstones 12, 13 via a support block 14. The support block 14 is provided with two arms 14*a*, 14*b* spaced at a certain angle, and rotation shafts 12*a*, 13*a* of the rotary whetstones 12, 13 extend upwards from the vicinities of front ends of the arms 14*a*, 14*b*, respectively. The rotary whetstones 12, 13 have, at front ends thereof, flat surfaces 12*b*, 13*b* perpendicular to the rotation shafts 12*a*, 13*a* as grinding surfaces to grind the one side 11*b* and the other side 11*c* of the cutting edge 11*a* of the cutting blade 11, respectively. The rotary drive for the rotary whetstone 12,13 is performed, for example, via pulleys 12*c*,13*c*. The whetstone holding mechanism 15 can move linearly along a drive shaft, which is shown only with a center line in order to simplify. The linear movement makes it possible to change over between a standby state, in which both of the flat surface 12*b* of the rotary whetstone 12 as a one side use abrasive whetstone and the flat surface 13*b* of the rotary whetstone 13 as an other side use abrasive whetstone are away from each of the one side 11*b* of the cutting edge 11*a* of the cutting blade 11 and the other side 11*c*
of the same, and a one side grinding state, in which the flat surface 12*b* of the rotary whetstone 12 is put in contact with the one side 11*b* of the cutting edge 11*a*, or an other side grinding state, in which the flat surface 13*b* of the rotary whetstone 13 is put in contact with the other side 11*c* of the cutting edge 11*a*. The change over between the grinding states is performed by change over mechanisms 17, 18. Even when the process of grinding progresses, since the parallelism between the flat surface 12*b*, 13*b* and the one side 11*b* or the other side 11*c* of the cutting blade is kept, the cutting edge angle is kept constant.

Figure 2:
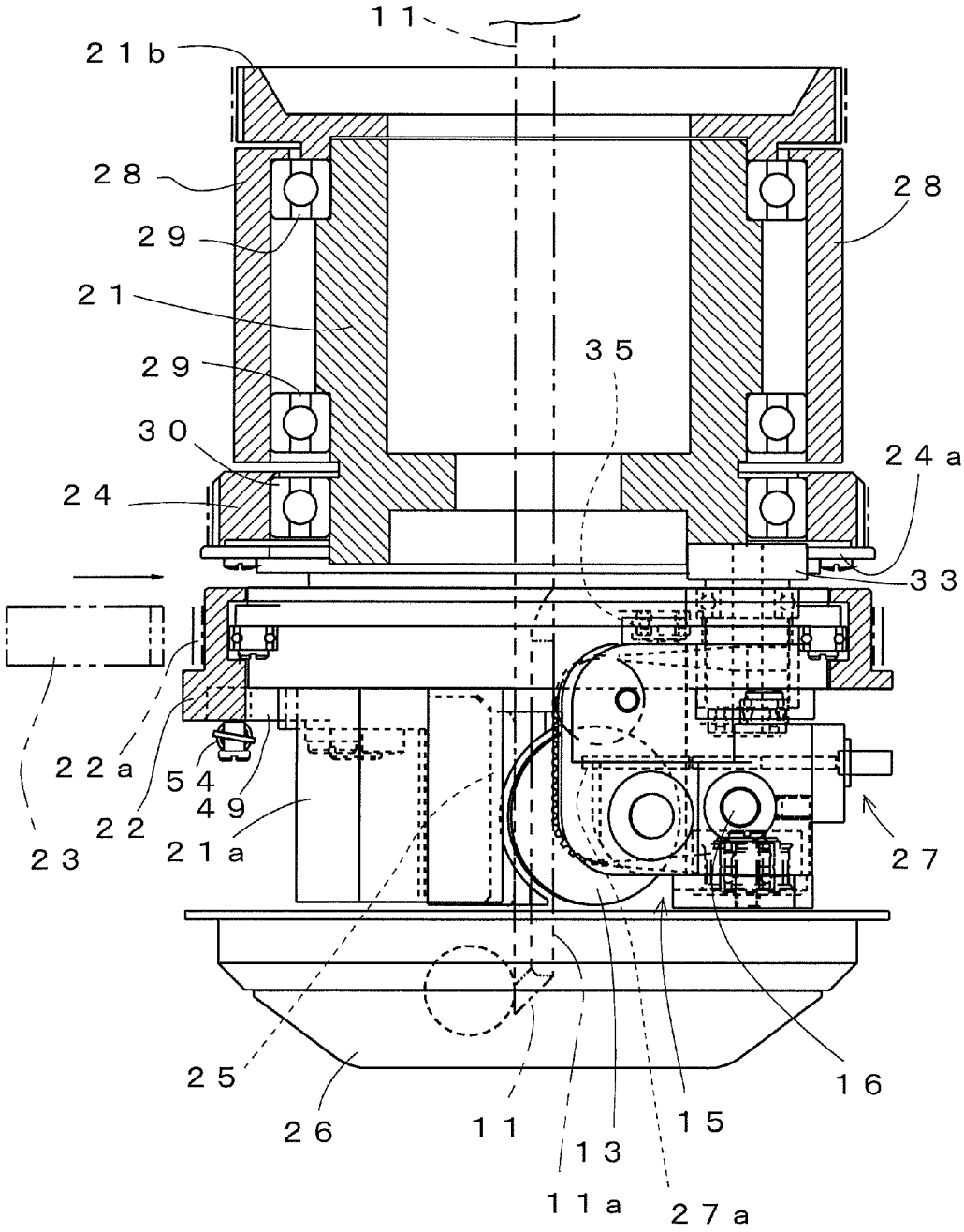
FIG. 2 shows a front sectional view showing a schematic structure of a cutting head 20 used in the cutting machine 10 of FIG. 1.

FIG. 2 shows a schematic structure of the cutting head 20 used in the cutting machine 10 of FIG. 1. FIG. 2 corresponds to a right side view of the construction of the cutting machine 10 shown in FIG. 1. The cutting head 20 includes the drive mechanism and the like, placed over the cutting blade 11, for driving the cutting blade 11 in reciprocation, though omitting its illustration. Turning around an R axis as a turning axis of the cutting edge to change the cutting direction of the cutting blade 11, is performed by turning of a turning cylinder 21. A slide ring 22 is provided under the turning cylinder 21, and turns to follow the turning cylinder by a mechanism will be described later. A lock mechanism 23 is provided at the outside of the slide ring 22 to lock outer teeth 22*a* of the slide ring 22 so that the slide ring 22 can be locked to stand still to the cutting head 10. The change over between the grinding states, is performed only by turning the turning cylinder 21 while the slide ring is locked by the lock mechanism 23.

There is provided a rotation ring 24 over the slide ring 22 and under the turning cylinder 21. The turning cylinder 21 has legs 21*a* extending downwards from the slide ring 22 and supporting a knife guide 25 thereon. The knife guide 25 supports the cutting blade 11 so that the cutting blade 11 can be prevented from being deformed or displaced when moved vertically. The legs 21*a* support a foot presser 26 at lower ends thereof. The foot presser 26 is to be put on the sheet material and the like to be cut. The whetstone holding mechanism 15 is supported at a position opposed to the knife guide 25, as described later, by the guide shaft 16 which is supported by the bottom surface of the turning cylinder 21 and is penetrating through the whetstone holding mechanism 15. The whetstone holding mechanism 15 is capable not only a linear displacement along the guide shaft 16 but also an oscillating displacement around the guide shaft 16. Though the oscillation displacement is performed by a guide of a follower 35 which is supported on the bottom surface of the turning cylinder 21, explanations for a mechanism to make a oscillating movement, are to be described later.

The whetstone holding mechanism 15 is provided with a detecting mechanism for cutting edge position 27 which detects a position of the cutting edge 11*a* of the cutting blade 11, and detects a wear state caused by grinding the cutting blade 11. To detect a position of the cutting edge 11*a*, the top end of a pin 27*a* is contacted with the cutting edge 11*a*. The turning cylinder 21 is supported on a support frame 28 of the cutting head 20 to freely rotate through a shaft bearing 29. On upper portion of the turning cylinder 21, a pulley 21*b* is mounted to receive a rotary drive force given form outside. The rotation ring 24 is supported by the turning cylinder 21 capable of free rotating through the shaft bearing 30. The rotation ring 24 is wound with timing belt around the outside periphery and receives rotary drive force so as to drive the rotary whetstones 12,13 through the gear 33 which engages the inner teeth of the inner teeth plate 24*a*. It is described later as for a lever 49 and a spring 54.

Figure 3:
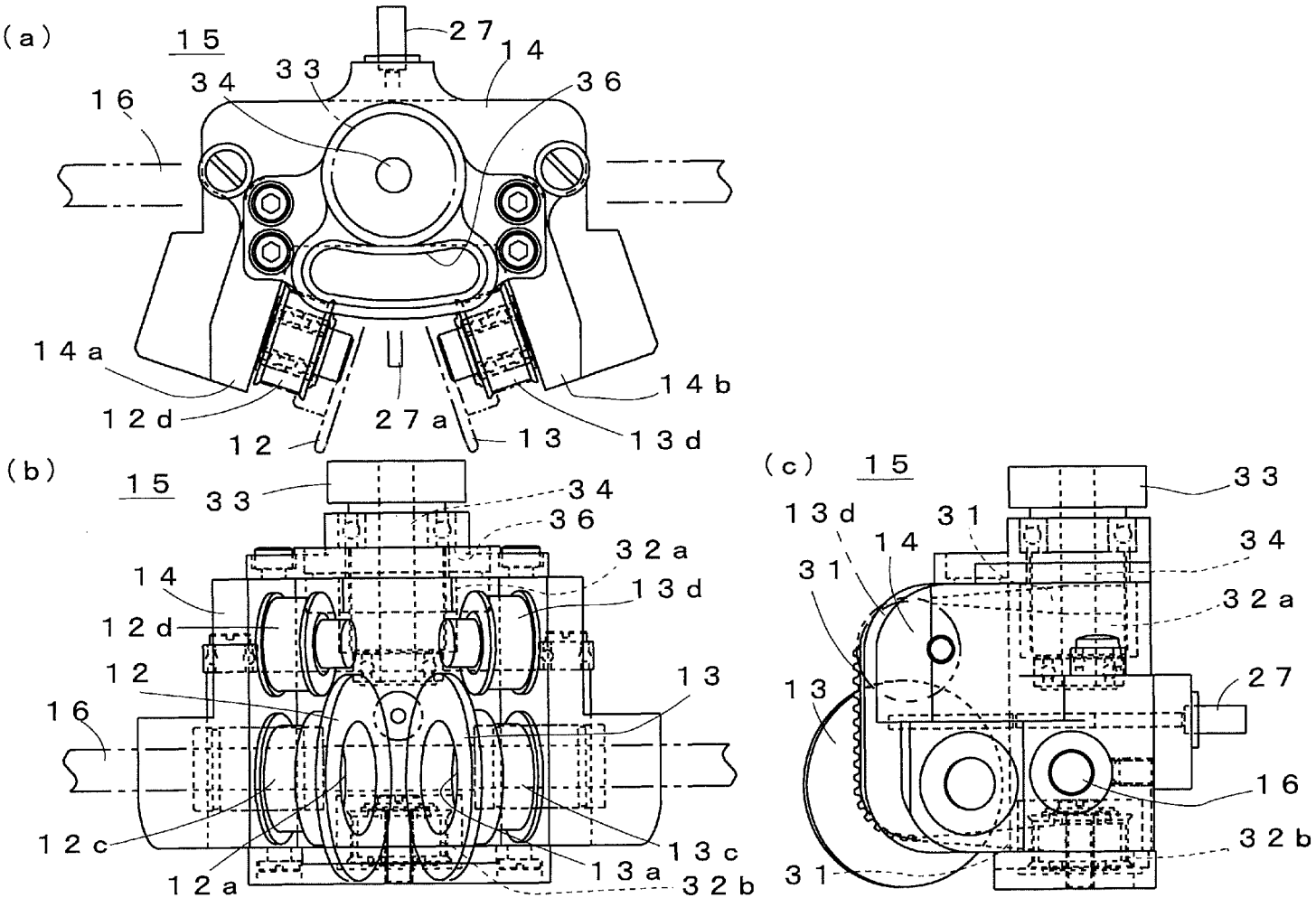
FIG. 3 shows a plan view, a front view and a right side view showing a structure of a whetstone holding mechanism 15 of FIG. 2.

FIG. 3 shows the structure of the whetstone holding mechanism 15 of FIG. 2. FIG. 3(*a*) as a plan view, FIG. 3(*b*) as a front view and FIG. 3(*c*) as a right side view, the construction is shown respectively. Each rotary whetstone 12, 13 is provided with a timing belt 31 wound between pulley 12*c*, 13*c* which is mounted to the rotary shaft 12*a*, 13*a* and up step pulley 12*d*, 13*d*. The timing belt 31 is extended to wind around upper and lower pulley 32*a*, 32*b*. The upper pulley 32*a* is mounted at a lower end of the drive shaft 34 at the upper end of which the gear 33 is mounted. The lower pulley 32*b* rotates freely. Through the support block 14, the guide shaft 16 penetrates in horizontal direction which is perpendicular to the vertical drive shaft 34. The support block 14 is capable of linear move along the guide shaft 16 as well as capable of oscillating movement around the guide shaft 16. The support block 14 is provided with a cam groove 36 which fits the follower 35 described above, by the linear displacement along the guide shaft 16 as well as the oscillating displacement, moving trajectory of the gear 33 is able to be made closer to a circular arc.

Figure 4:
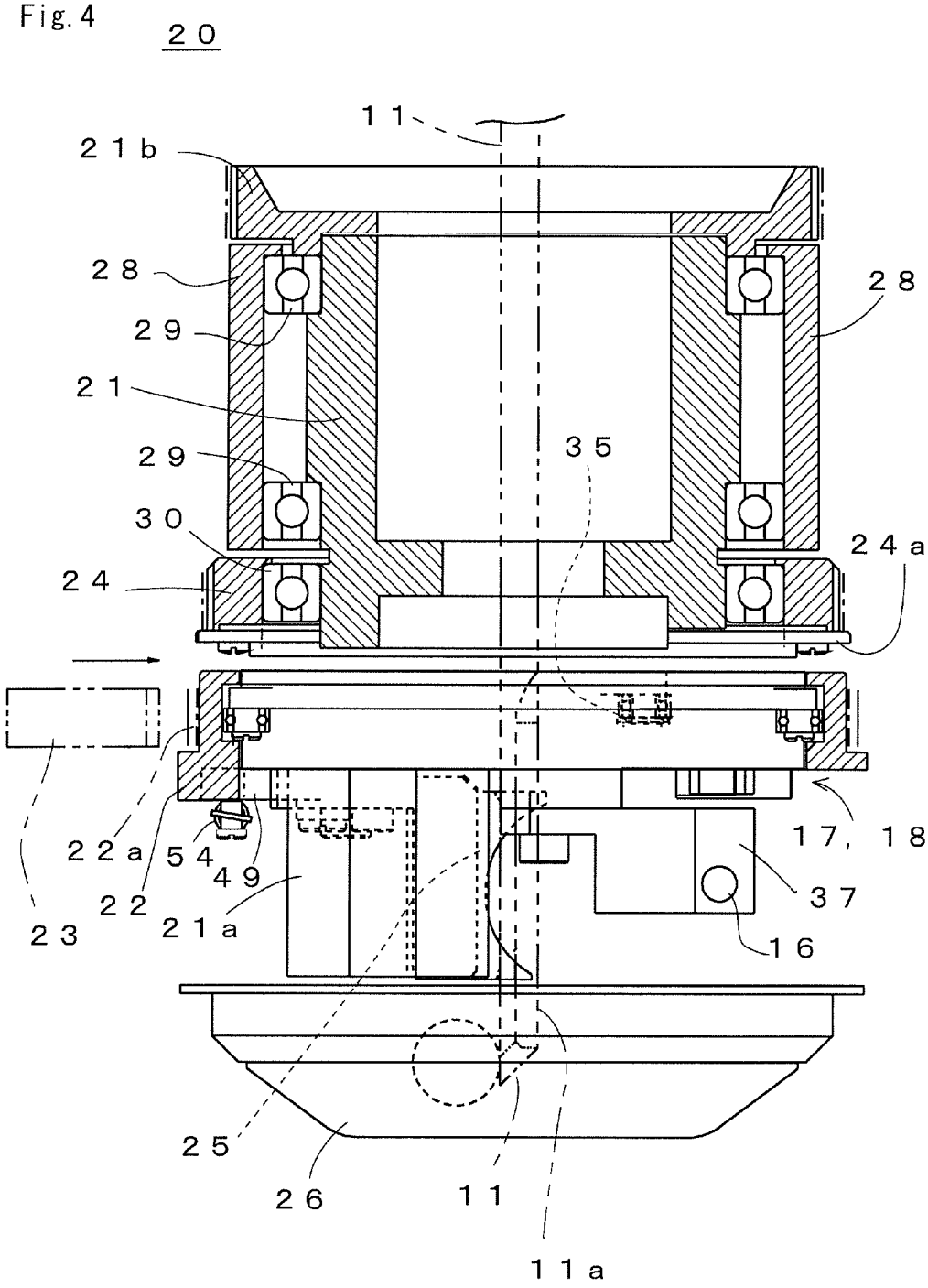
FIG. 4 shows a front sectional view showing a structure of the cutting head 20 of FIG. 2 from which the whetstone holding mechanism 15 is omitted.

FIG. 4 shows a structure of the cutting head 20 of FIG. 2 excluding the whetstone holding mechanism 15. On the bottom surface of the turning cylinder 21 is mounted the above described follower 35 as well as a support platform 37 which supports the guide shaft 16. On the bottom surface of the slide ring 22, are also mounted with change over mechanisms 17, 18 shown in FIG. 1. On the lower part of the rotation ring 24, is mounted with the inner teeth plate 24*a*, the inner teeth on the inside periphery of the inner teeth plate 24*a* engage with the above described gear 33.

Figure 5:
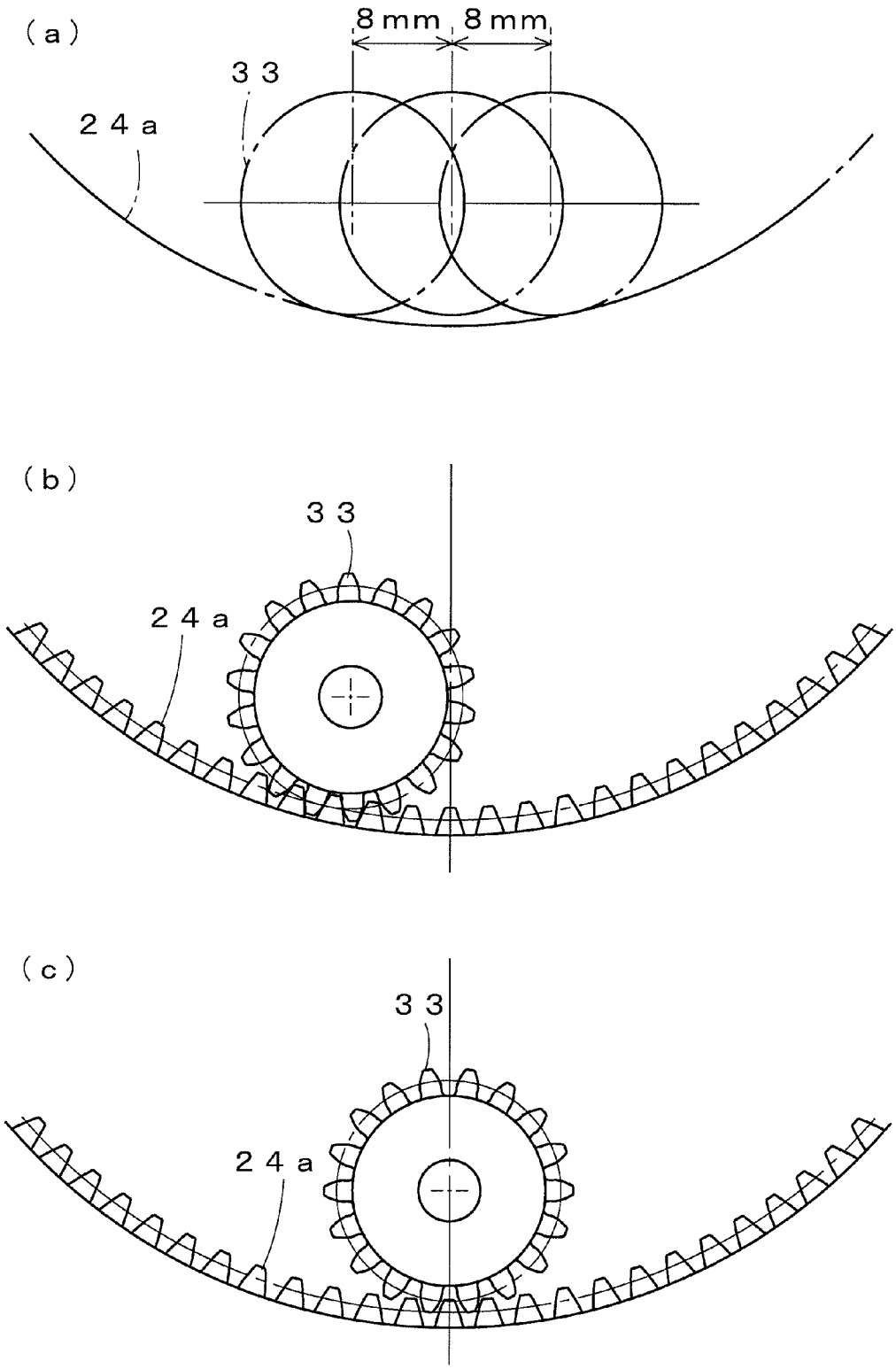
FIG. 5 shows changing states of the engagement between the gear 34 and the inner teeth of the inner teeth plate 24*a*, while the support block 14 is moved linearly along the guide shaft 16 in the cutting head 20 of FIG. 2.

FIG. 5 shows changing states of engaging between the gear 33 and the inner teeth of the inner teeth plate 24*a*, while the support block 14 is moved linearly along the guide shaft 16. FIG. 5(*a*) shows misalignment between the pitch circle of the inner teeth and the pitch circle of the gear 33, to the linear displacement along the guide shaft 16. A central reference position corresponds to the standby position for grinding. It could be set that from the reference position, to move by, for example, 8 mm in left or right direction, the one side grinding state or the other side grinding state could be reached and the pitch circles of the gear 33 and the inner teeth coincide as shown in FIG. 5(*b*). Between the inner teeth and the gear 33 the pitch circles coincide so that the rotary drive force for the rotary whetstones 12, 13 is able to be transmitted surely. If the gear 33 makes parallel displacement without changing the direction of the rotate shaft 34, at the reference position as shown in FIG. 5(*c*), the amount of engaging becomes shallow. The whetstone holding mechanism 15 of the present embodiment is capable of oscillation displacement to the rotate shaft 34 so as to the pitch circles almost coincide and to make the gear 33 closer to the inner teeth side. In the vicinity of the reference position, even if the pitch circles do not coincide perfectly, rotation load is not generated because the flat surfaces 12*b*, 13*b* of the rotary whetstones 12, 13 are away form both of the one side 11*b* and the other side 11*c* of the cutting edge 11*a*, so that there is no problem.

Figure 6:
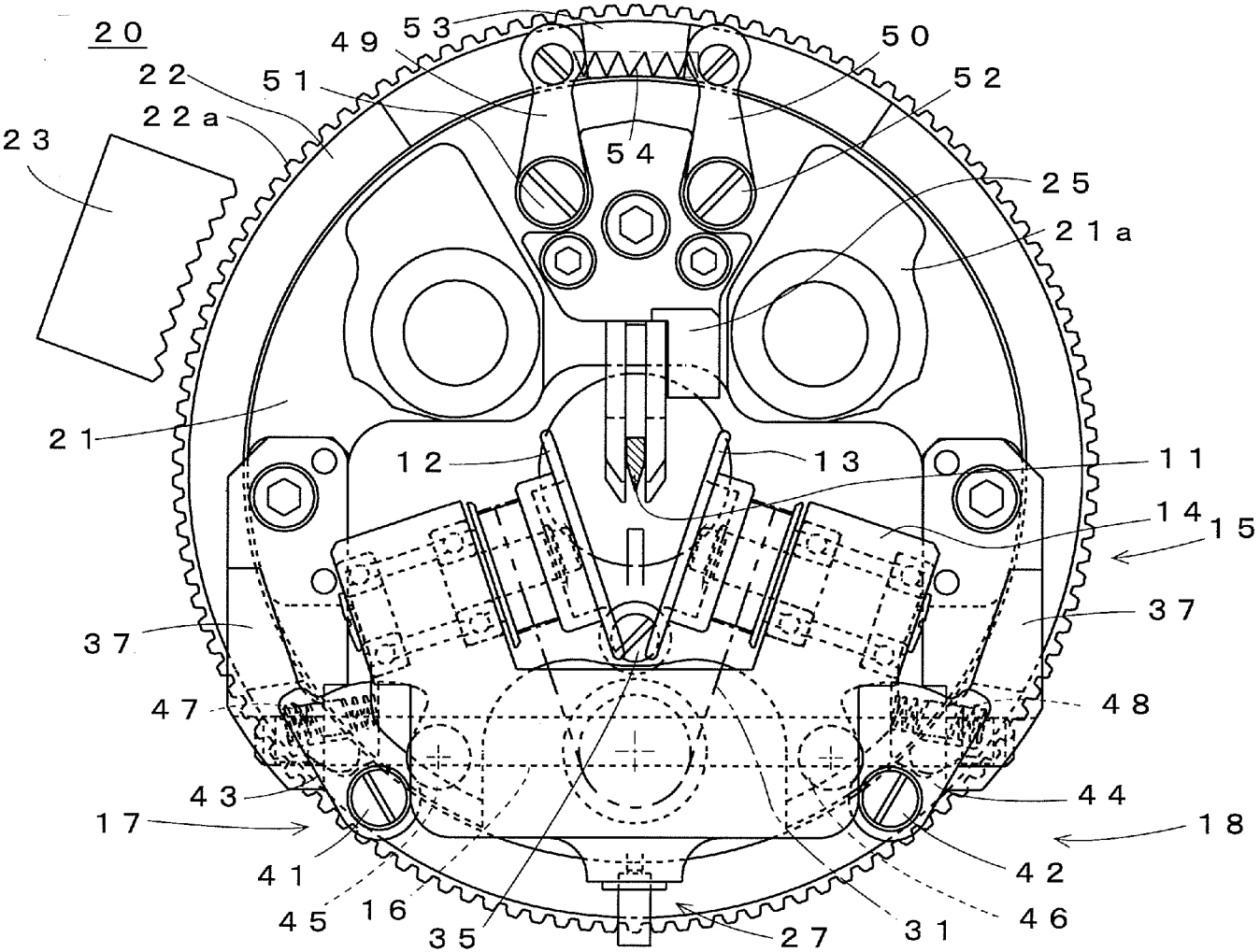
FIG. 6 shows a plan sectional view of the cutting head 20 of FIG. 2, in a state where the slide ring 22 is not locked by the lock mechanism 23.

FIG. 6 shows a sectional bottom view of the structure of the cutting head 20 of FIG. 2, in a state the slide ring 22 is not locked by the lock mechanism 23. On the outside of the periphery of the slide ring 22 and on the inside of the periphery of the lock mechanism 23 which facing to the slide ring 22, teeth are provided to engage each other. For example, in case the slide ring 22 is made with metal material and the like, it could be possible to integrate the outer teeth 22*a* to make on the out side periphery, it could be also possible to adhere timing belt made from rubber material like polyurethane rubber to the out side as outer teeth 22*a*. The change over mechanisms 17, 18 of FIG. 1 includes pivoted cams 43, 44 which are supported at the rear end side to the slide ring 22 by the pivot shafts 41, 42. Compression springs 47, 48 are provided between the slide ring 22 and the pivoted cams 43, 44 respectively and bias the pivoted cams 43, 44 so that the cam surfaces provided with at side position to contact with the followers 45, 46 respectively mounted on the support block 14.

One pair of levers 49, 50 are provided in the hind side of the cutting blade 11. The levers 49, 50 are supported by pivoted shafts 51, 52, which are arranged to the knife guide 25 side with a narrow space, in a state capable of free oscillating displacement. The front end sides of the levers 49, 50 pinch a projection portion 53. A tension spring 54 is provided between the levers 49, 50 biasing them so as to pinch the projection portion 53 securely with the front end sides of the levers 49, 50. Such an action of the levers 49, 50 makes it possible for the slide ring 22 to follow turning of the turning cylinder 21, and the displacement angle of the turning cylinder 21 to the slide ring 22 is kept at the reference angle of 0 degree.

Figure 7:
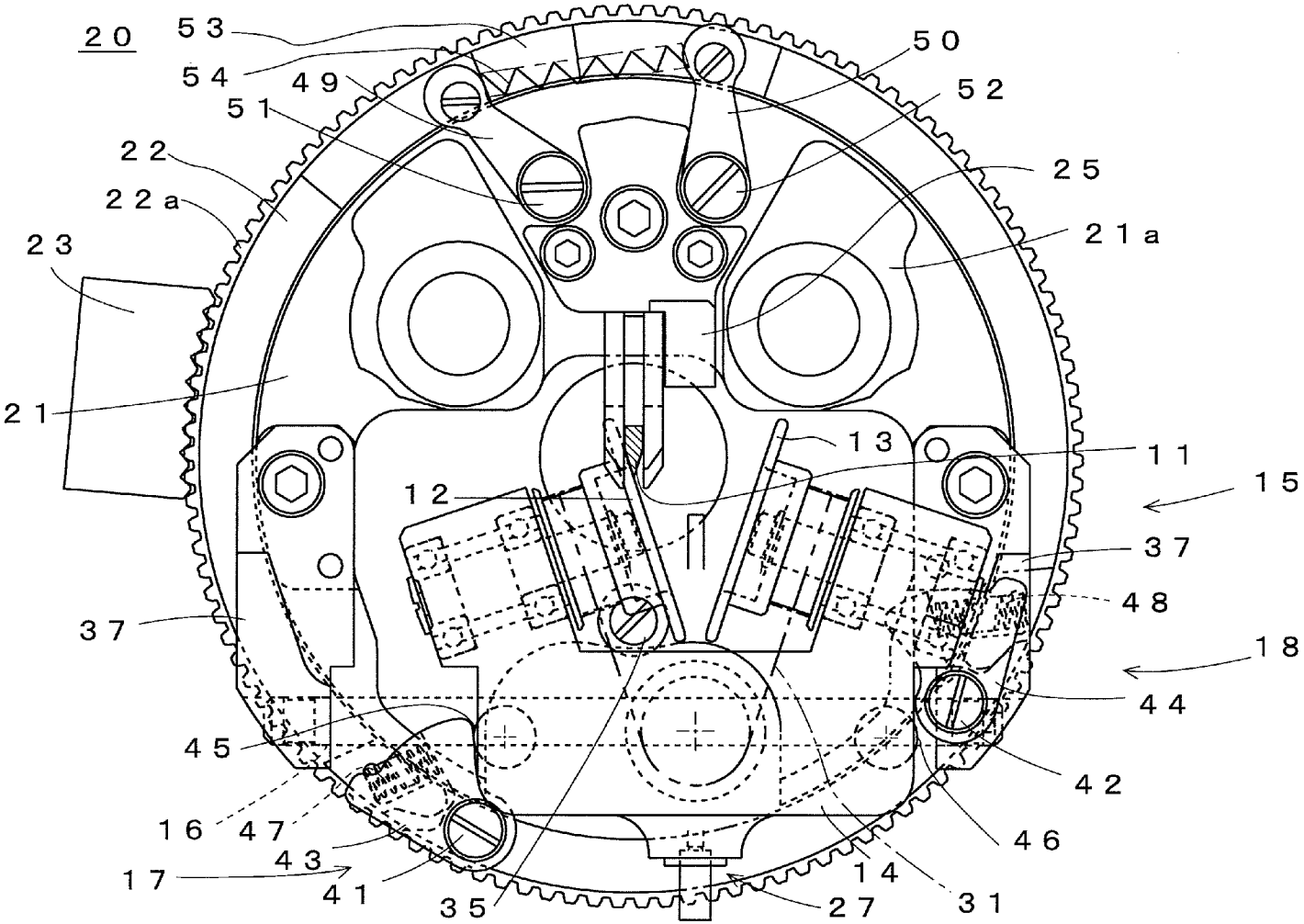
FIG. 7 shows a plan sectional view of the cutting head 20 of FIG. 2, in a state where the slide ring 22 is locked by the lock mechanism 23 and the turning cylinder 21 makes 15 degrees of angular displacement in the counter-clockwise direction to the slide ring 22.

FIG. 7 shows on the contrary to FIG. 6 a state in which the lock mechanism 23 locks the slide ring 22 and the turning cylinder is displaced by the angle of 15 degrees to the slide ring 22 in the counter-clockwise direction. Corresponding to the angle of 15 degrees, the support block 14 performs the linear displacement of the 8 mm shown in FIG. 5(*a*) along the guide shaft 16. As described above, teeth are provided with the outside of the periphery of the slide ring 22 and the inside of the periphery of the lock mechanism 23, so that it is possible to lock surely. As the position of the leg 21*a* is however shown similar to that of FIG. 6, for the sake of convenience to explain, the slide ring 22 is locked to stand still but is shown in an angular displacement state. The left side follower 45 of the support block 14 is pushed rightward of the drawing by the pivoted cam 43. The right side follower 46 is apart from the pivoted cam 44 so as to receive no action by the pivoted cam 44. The support block 14, capable of moving along the guide shaft 16, moves rightward in the drawing.

FIG. 6 shows the relationship between the whetstone holding mechanism 15 and the cutting blade 11 of FIG. 7 as viewed from downward. When the follower 45 is pushed rightward by the pivoted cam 43, the flat surface 12*b* of the rotary whetstone 12 is compressed to the one side lib of the cutting edge 11*a* so that grind is done. The angle of the turning cylinder 21 is set as a standard angle for grinding. As shown in FIG. 6 and FIG. 7, the pivoted cams 43, 44 are pressed inward by the compression springs 47, 48. While grinding, this compression force is acting.

Figure 8:
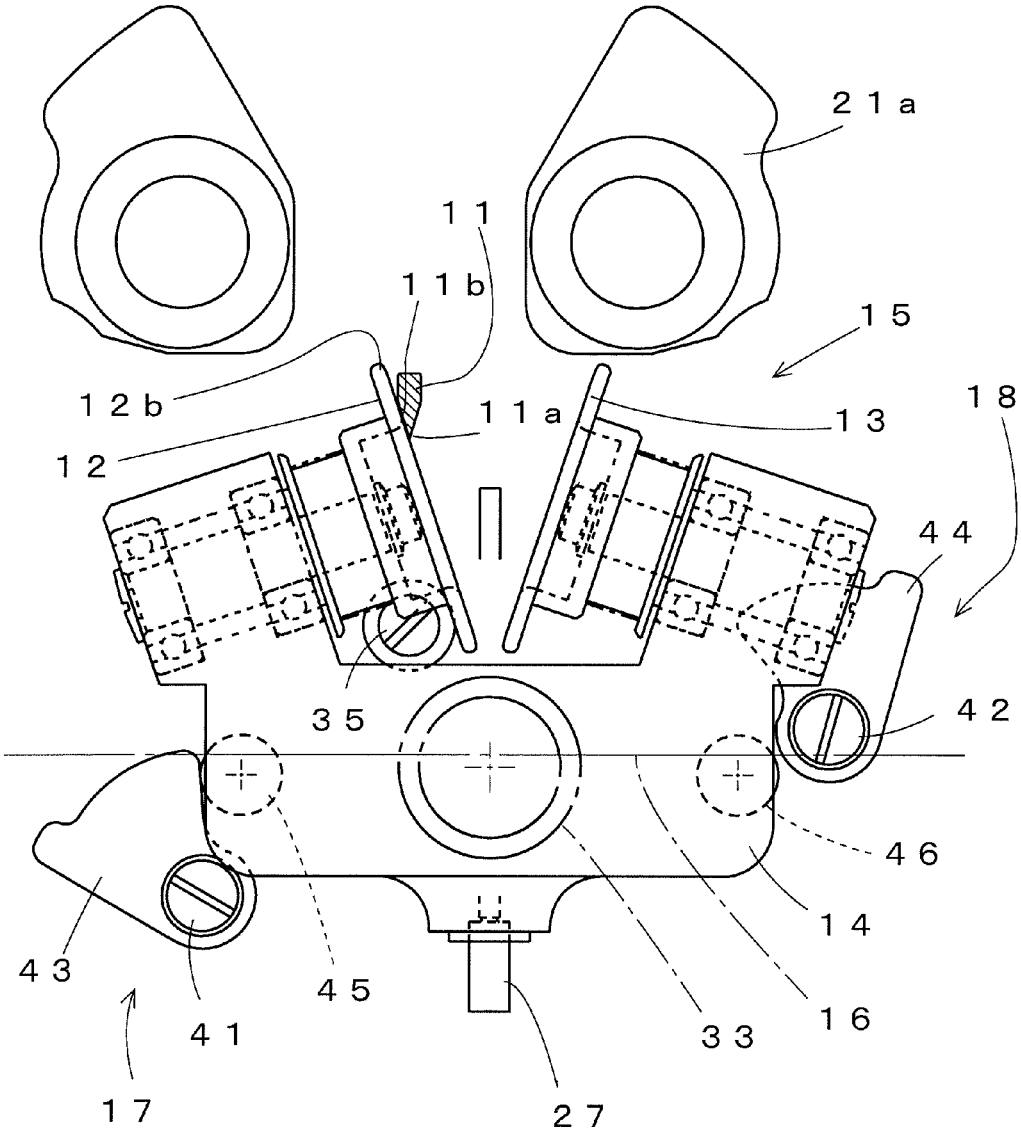
FIG. 8 shows a sectional bottom view, in which the relationship of FIG. 7 between the whetstone holding mechanism 15 and the cutting blade 11 is shown from downward.
Figure 9:
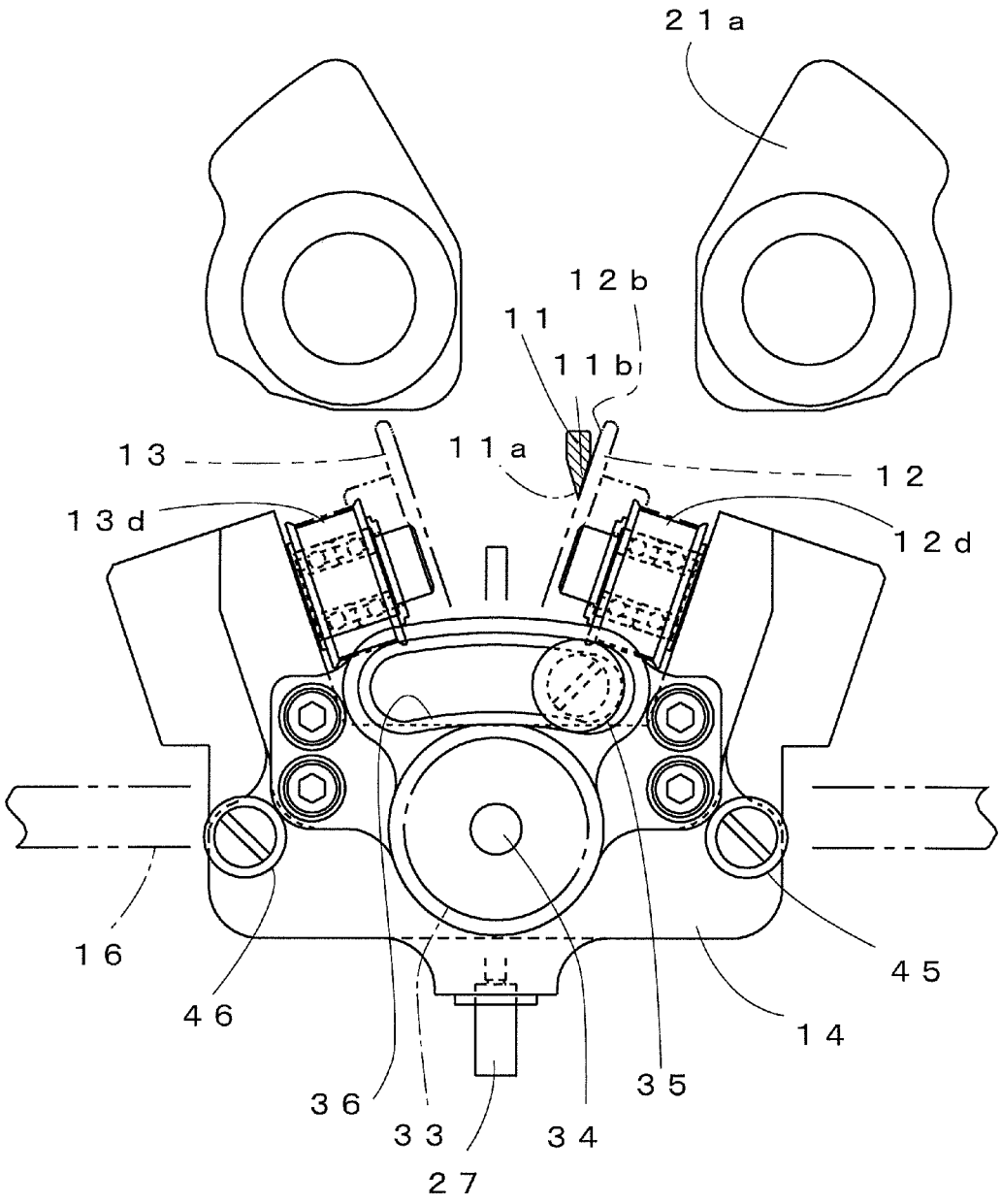
FIG. 9 shows a sectional plan view of the structure in which both pitch circles of the gear 33 and the inner teeth of the inner teeth plate 24*a* consist with each other at the angle 15 degrees of FIG. 8.

FIG. 9 shows a plan view of the structure to adapt the pitch circle of the gear 33 and that of the inner teeth of the inner teeth plate 24*a* to the angle of 15 degrees as shown in FIG. 8. Into the cam groove 36 set to the support block 14, the follower 35, shown in FIG. 2 and the like, is fitted. As is shown in the drawing, the drive shaft should be perpendicular to the paper surface, the pitch circle of the gear 33 should consist with the pitch circle of the inner teeth of the inner teeth plate 24*a*, and fitting should be performed properly, the shape of the cam groove 36 is so determined. Progress of grinding brings increase in the angle of the turning cylinder 21 in order to act the same compression force. For example, when the angle reaches to 15 degrees, the cutting blade 11 is stopped to use. However, with such amount of change, the compression springs 47, 48 are still able to compress sufficiently, even if the angle remains at 15 degrees, there is no need to change the angle. In this case, the moving distance of the support block 14 from the reference position is 8.5 mm. Such displacement like as 0.5 mm, misalignment of engaging might be negligible, but, by the shape of the cam groove 36 being properly determined, the rotary shaft 34 could be made oscillating displacement to be apart from the inner teeth, so that it could be compensated to avoid too deep engaging.

Figure 10:
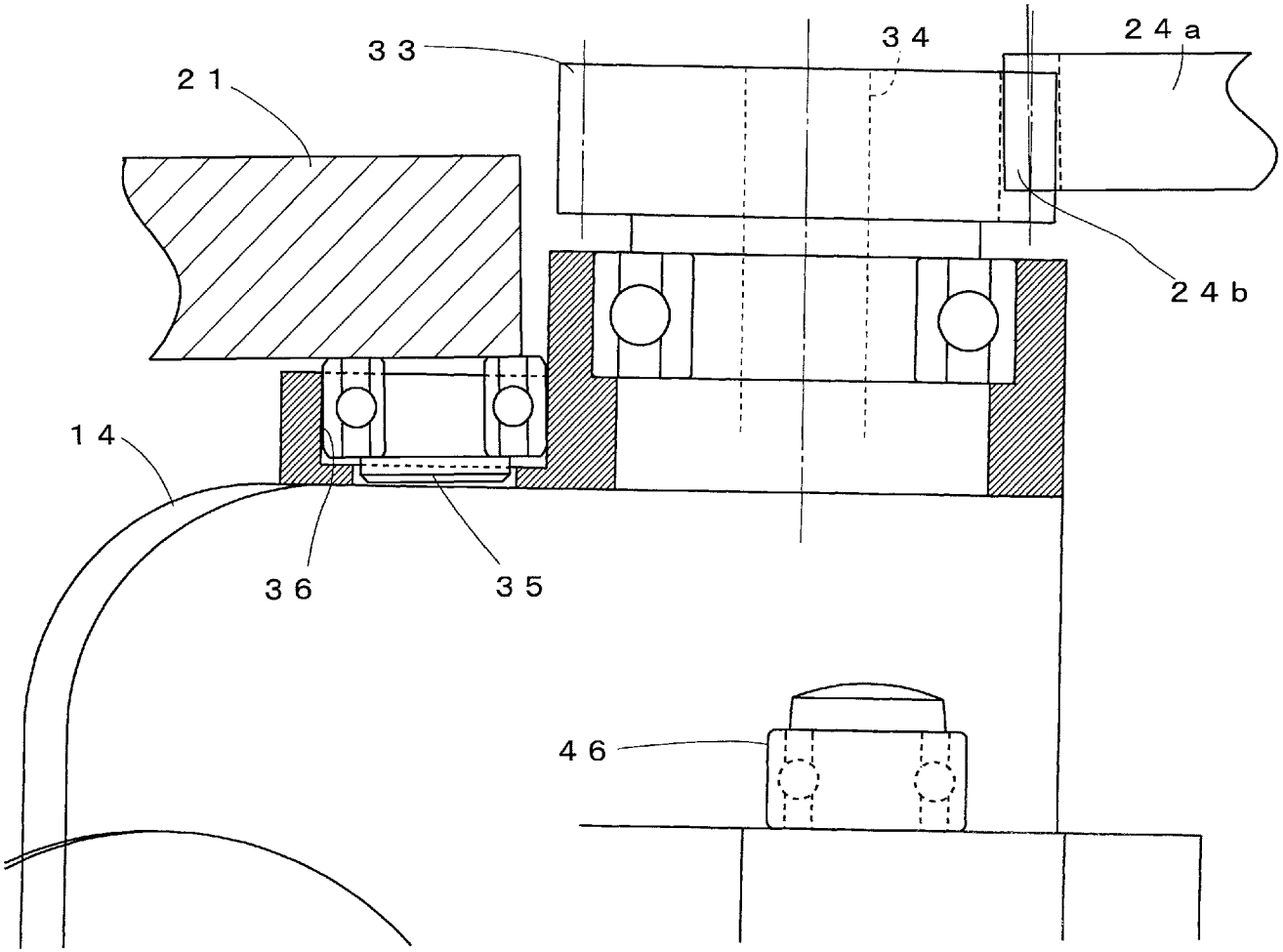
FIG. 10 shows a sectional view for the partial structure of the engaging portion between the gear 33 and the inner teeth 24*b* at the reference position shown in FIG. 5(*a*).

FIG. 10 shows the structure of the engaging portion between the gear 33 and the inner teeth 24*b* of the inner teeth plate 24*a* at the reference position shown in FIG. 5(*a*). If the diameter of the follower 35 and the width of the cam groove 36 are set to an identical size, by a settings of plus tolerance, the follower 35 could tilt the support block 14 in the cam groove 36, so that tilting of the drive shaft 34 could bring the gear 33 closer to the inner teeth 24*b*.

Figure 11:
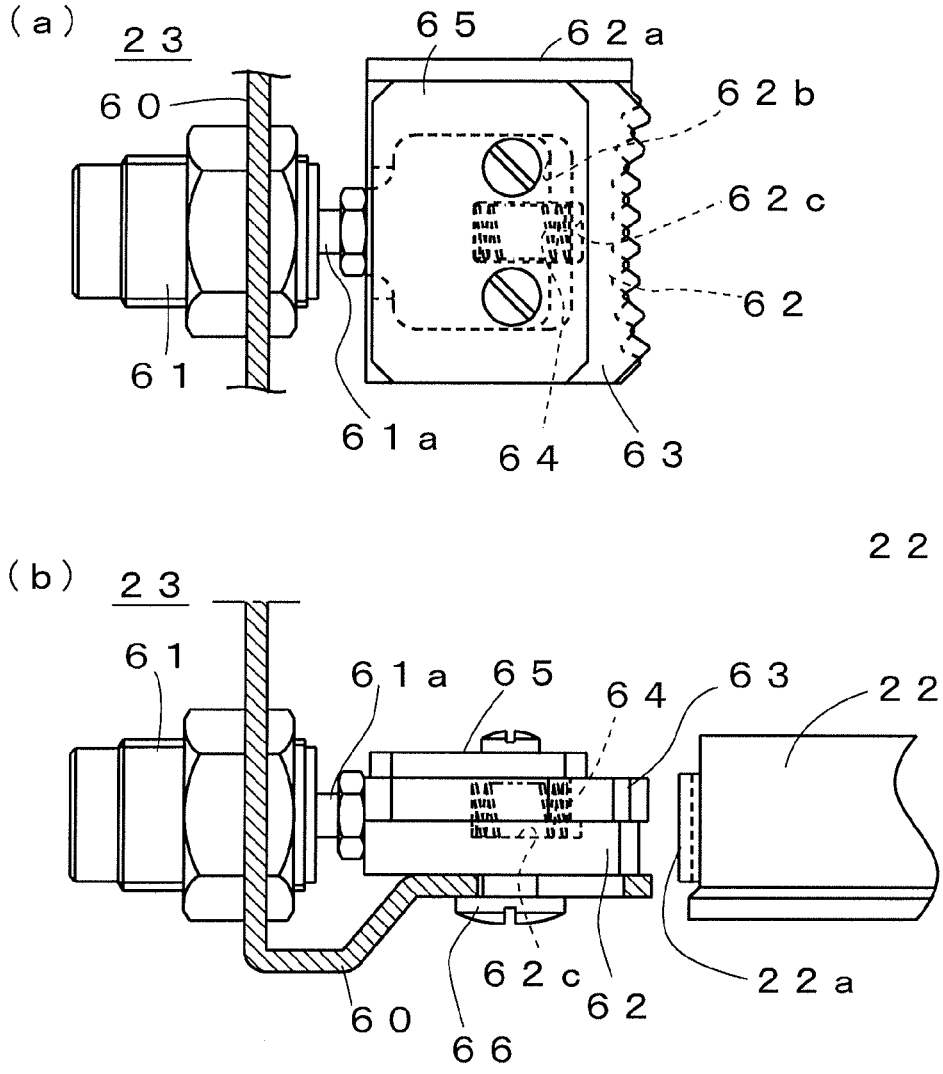
FIG. 11 shows a plan view and a front view showing the structure of the lock mechanism of FIG. 2.

FIG. 11 shows the structure of the lock mechanism 23. FIG. 11(*a*) is a partial plan view, and FIG. 11(*b*) is a partial front view. In the lock mechanism 23, on a mounting plate 60, which is mounted to the support frame of FIG. 2, an air cylinder 61, which becomes a drive actuator, is mounted. On an output rod 61*a* of the air cylinder 61, a lower step tooth 62 is mounted. On an upper surface of the lower step tooth 62, a projecting portion 62*a* at one side, a projecting portion 62*b* and a groove 62*c* at near center are provided. Between the projecting potions 62*a*, 62*b*, a upper step tooth 63 is equipped and is biased to the outer teeth 22*a* side by a spring 64 fitted in the groove 62*c*. Above the upper step teeth 63, an upper cover 65 is mounted. As shown in FIG. 11(*a*), with biasing by the spring 64, tooth tops of the upper step tooth 63 project to the outer teeth 22*a* side. Between the upper step tooth 63 and the lower step tooth 62, there exists a misalignment of one half pitch. The lower step tooth 62 is mounted to the mounting plate 60 by a stepped screw 66 and is capable of slid displacement. In the mounting plate 60, a long opening is formed and is penetrated by the stepped screw 66.

Figure 12:
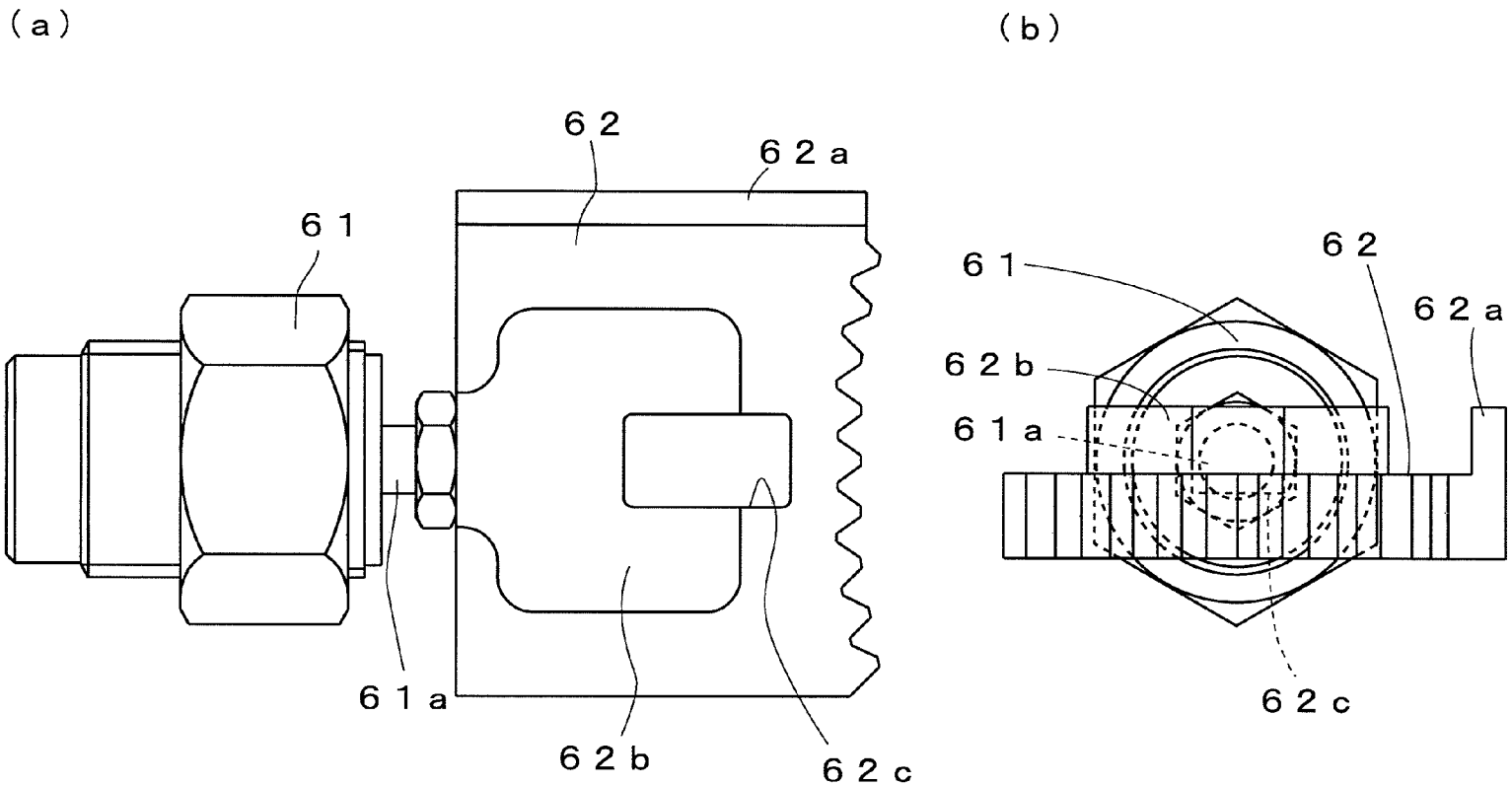
FIG. 12 shows a plan view and a right side view showing the structure in which the lower step teeth 62 are mounted to the output rod 61*a* of the air cylinder 61 of FIG. 11.
Figure 13:
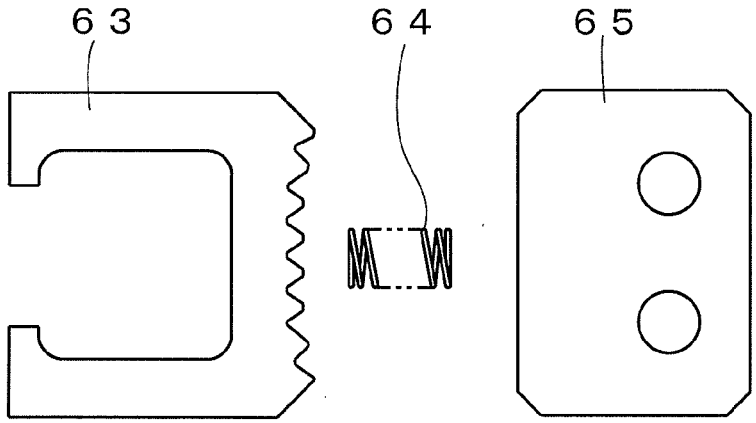
FIG. 13 shows a plan view showing the structure of the upper step teeth 63, the spring 64 and the upper cover 65 of FIG. 11.

FIG. 12 shows the structure in which the lower step tooth 62 is mounted to the output rod 61*a* of the air cylinder 61. FIG. 12(*a*) is plan view, and FIG. 12(*b*) is a right side view. Further FIG. 13 shows a plan view of the structure of the upper step tooth 63, the spring 64 and the upper cover 65.

Figure 14:
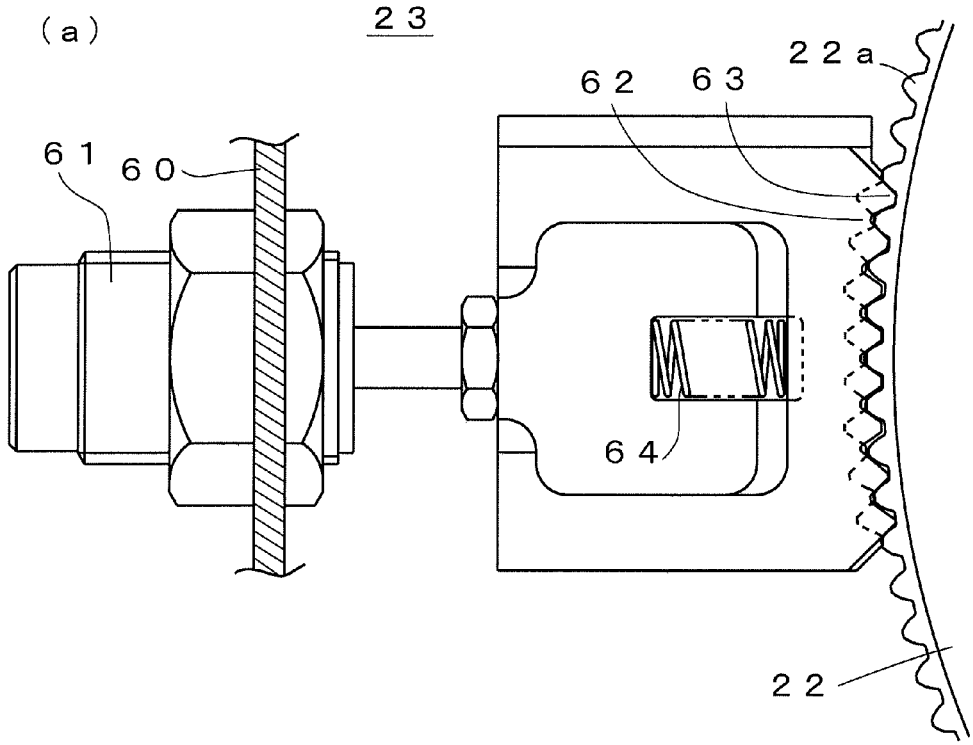
FIG. 14 shows a plan view showing a state in which the lock mechanism 23 of FIG. 11 locks the slide ring 23.
Figure 14:
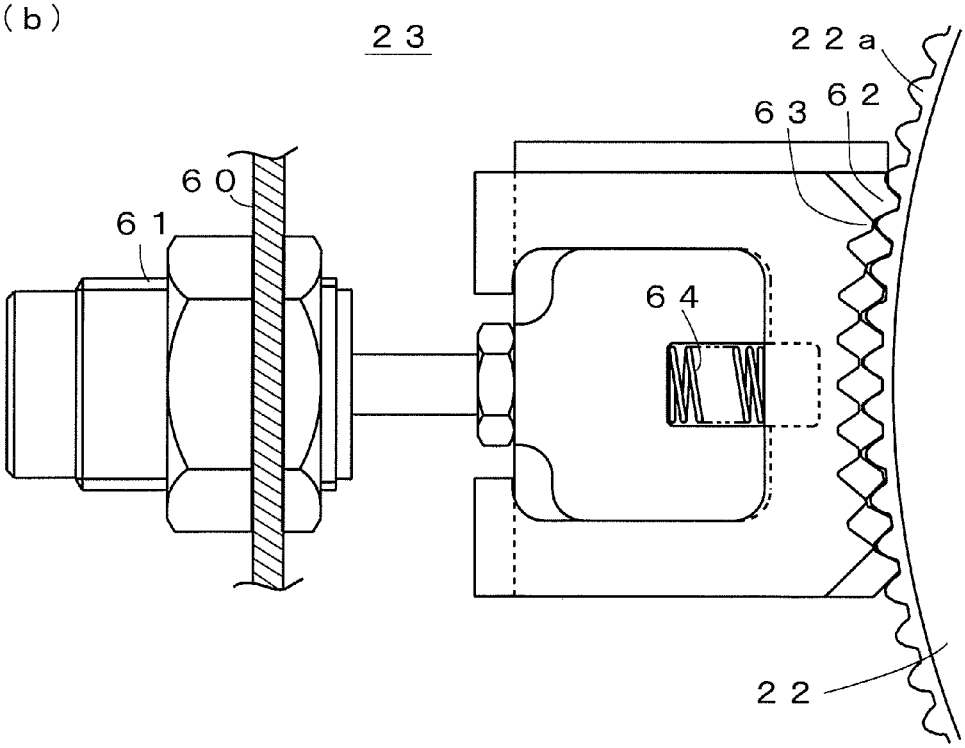
Figure 15:
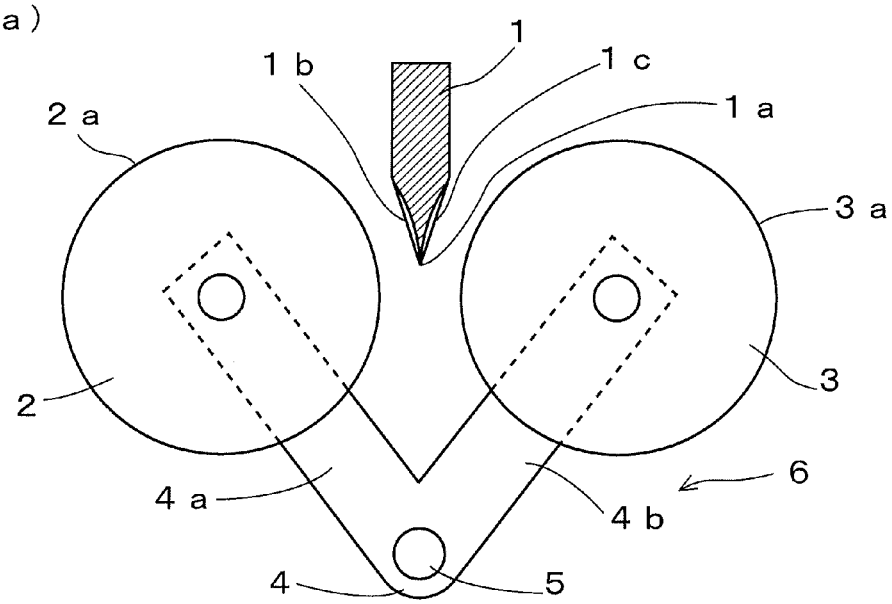
FIG. 15 shows sectional views showing simplified illustrations of two different known concepts to grind the cutting edge.
Figure 15:
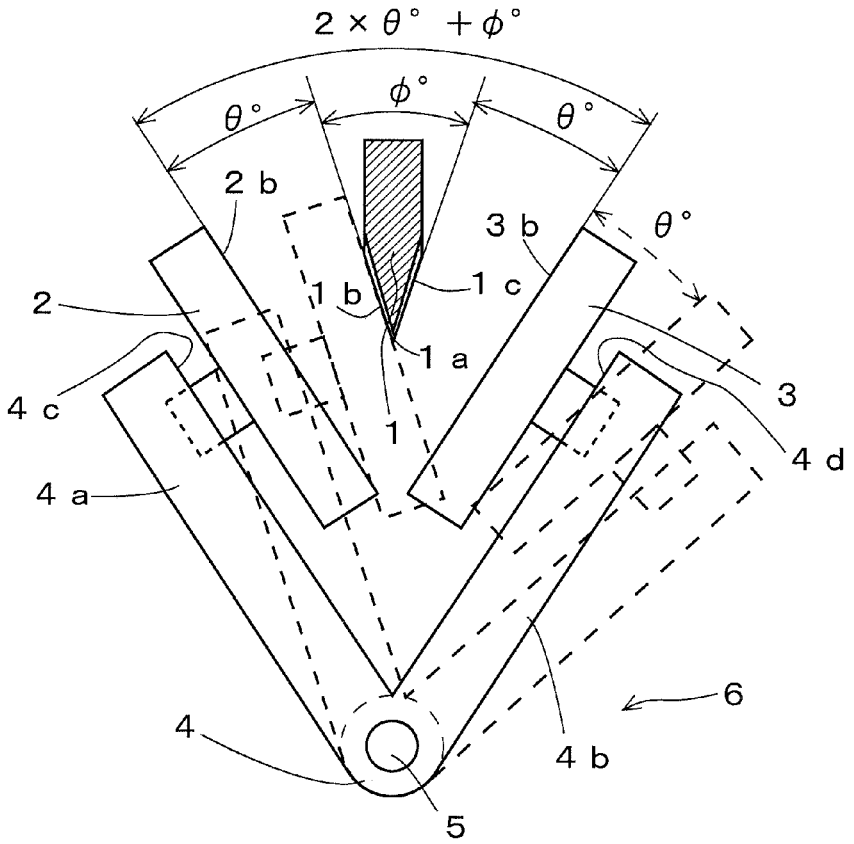

FIG. 14 shows a state in which the lock mechanism 23 performs to lock the outer teeth 22*a* of the slide ring 22. Illustration of the upper cover 65 is omitted. Tooth tops of the lower tooth 62 and the upper tooth 63 of the lock mechanism act as a brake and engage with the outer teeth 22*a* of the slide ring 22 to lock it. FIG. 14(*a*) is a state in which the upper step tooth 63 engages with the outer teeth 22*a*, FIG. 14(*b*) is a state in which the lower step tooth 62 engages with the outer teeth 22*a*, respectively. When the air cylinder 61 is started to push out the lower step tooth 62, at first, the upper step tooth 63, which is set to project, comes close to the outer teeth 22*a*. In case of both the upper step tooth 63 and the outer teeth 22*a* are capable of engaging with threads and roots each other, soon the state shown in FIG. 14(*a*) is realized, so that the slide ring 22 is locked. In case of facing threads to threads and roots to roots between the upper step tooth 63 and the outer teeth 22*a*, the upper teeth 22*a* is pushed and goes back, as shown in FIG. 14(*b*), it becomes to a state in which the lower step tooth 62 engages with the outer teeth 22*a*.

If the outer tooth is made of rubber material like as polyurethane rubber, because of elasticity, even if the coincidence of the tooth to tooth is not perfect, a little amount of misalignment is allowable. But if the brake is made of a single step teeth, the misalignment may reach one pitch at most until engaging is performed. By shifting of one half pitch between the upper step tooth 63 and the lower step pitch 62, the misalignment can be decreased to one half pitch at most. If the number of steps might increase, the misalignment could become smaller. It could be possible that no outer teeth 22*a* should be provided on the outside of the periphery of the slide ring 22, but a brake shoe, made of rubber or the like, could be provided on the lock mechanism 23 side.

Although the whetstone holding mechanism 15 is supported below the turning cylinder 21 in the embodiment illustrated above, since the structure is compact, the whetstone holding mechanism 15 may be properly arranged according to the structure of the cutting head 20, with less limitation on arrangement. Though the whetstone holding mechanism 15 is to be allowed the selective switch over between the grinding states by the turning of the R-axis, a power source, such as a motor, may be incorporated in the mechanism to move the whetstone holding mechanism by itself. Though the rotary whetstones 12, 13 are used to grind the cutting blade 11, in case that grinding is done during the cutting blade 11 is also moved, grinding is possible only by contact of still whetstone. Using the rotary whetstones 12, 13, grinding is performed with high speed, and productivity is avoided from decrease. For driving rotary whetstones 12, 13, drive source like a motor could be provided in the turning cylinder 21. Though the cutting blade 11 has a linear shape, to a rotating round cutter cutting, at least one point on the periphery, the concept of the present invention is to be applied to grind both side of cutting edge as like as the cutting blade 11.

In addition, in the whetstone holding mechanism 15, the rotary whetstone 12, 13 are provided at one step to left side and right side, whetstones could be provided at two steps by attaching rotary whetstones to upper step pulleys 12*d*, 13*d*. In this case, the diameter of the whetstones provided on upper step, should be smaller than the diameter of the rotary whetstones 12, 13.

The invention claimed is:

1. A cutting machine for cutting a sheet material to be cut, which is put on a cutting table, with a cutting blade provided in a cutting head movable along the cutting table, wherein the cutting head is provided with:

a turning cylinder for containing the cutting blade and capable of turning around an axis of rotation of the cutting edge perpendicular to a surface of the cutting table, to change a cutting direction of the cutting blade;

a slide ring provided on the outside of the turning cylinder and capable of following its turning direction;

a lock mechanism provided at a radially outer portion of the turning cylinder so as to lock the slide ring to the cutting head;

a whetstone holding mechanism which is contained in the turning cylinder and holds abrasive surfaces comprising a first abrasive whetstone for grinding a first side of the cutting edge of the cutting blade and a second abrasive whetstone for grinding a second side of the cutting edge of the cutting blade, wherein the abrasive surfaces are held with a space therebetween, a guide shaft, penetrated into the whetstone holding mechanism, for guiding the whetstone holding mechanism linearly, and a change over mechanism, supported by the turning cylinder, for moving the whetstone holding mechanism along the guide shaft, and for changing the whetstone holding mechanism between a standby state and a first side grinding state or a second side grinding state, in the standby state the abrasive surfaces of the first abrasive whetstone and the second abrasive whetstone being away from both sides of the cutting edge, in the first side grinding state the abrasive surface of the first abrasive whetstone being put in contact with the first side of the cutting edge, and in the second side grinding state the abrasive surface of the second abrasive whetstone being put in contact with the second side of the cutting edge;

wherein the orientation of the abrasive surface of the first abrasive whetstone in the standby state is parallel to its orientation in the first side grinding state and the second side grinding state, and the orientation of the abrasive surface of the second abrasive whetstone in the standby state is parallel to its orientation in the first side grinding state and the second side grinding state;

the turning cylinder is provided with a rotation ring capable of receiving a rotary drive force from outside and having inner teeth on the inside of the periphery, the whetstone holding mechanism is provided with a gear engaging with the inner teeth of the rotation ring, an engaging mechanism is further provided for displacing the whetstone holding mechanism in oscillation around the guide shaft so as to keep engaging between the gear and the inner teeth of the rotation ring and make moving trajectory of the gear closer to a circular arc, while moving the whetstone holding mechanism along the guide shaft, wherein said engaging mechanism includes:

a follower supported by said turning cylinder and fitted to a cam groove, which is provided in said whetstone holding mechanism, and wherein the cam groove includes a curved shape for the whetstone holding mechanism to make an oscillating displacement around the guide shaft while the whetstone holding mechanism moves linearly along the guide shaft, and the first abrasive whetstone and the second abrasive whetstone rotate by the rotary drive force which transmitted to the gear through the rotation ring from outside of the turning cylinder and grind the cutting blade.

2. The cutting machine according to claim 1, wherein said change over mechanism includes:

one pair of pivoted cams, which are supported at the rear end side to said slide ring, capable of pinching from both side of a portion of the whetstone holding mechanism through which said guide shaft penetrates, and in case said lock mechanism locks the slide ring, by the turning of said turning cylinder, one of the pivoted cam pushes the whetstone holding mechanism along the guide shaft, so that said change over is done between said standby state and a state in which one of the sides is ground.

3. The cutting machine according to claim 1, wherein said slide ring has teeth of a uniform pitch on the outside periphery, and wherein said lock mechanism, includes:

a brake provided with inner teeth separated by shifted phase into a plurality steps on the periphery, and biased by spring so as to have different projection amounts at every step, and a drive actuator drives the brake so as to advance and retreat inward of the turning cylinder and locks the slide ring by putting the inner teeth in contact with the teeth of the slide ring so as to engage when the brake advances.

4. The cutting machine according to claim 2, wherein said slide ring has teeth of a uniform pitch on the outside periphery, and wherein said lock mechanism, includes:

a brake provided with inner teeth separated by shifted phase into a plurality steps on the periphery, and biased by spring so as to have different projection amounts at every step, and a drive actuator drives the brake so as to advance and retreat inward of the turning cylinder and locks the slide ring by putting the inner teeth in contact with the teeth of the slide ring so as to engage when the brake advances.

5. A cutting machine for cutting a sheet material to be cut, which is put on a cutting table, with a cutting blade provided in a cutting head movable along the cutting table, wherein the cutting head is provided with:

a turning cylinder for containing the cutting blade and capable of turning around an axis of rotation of the cutting edge perpendicular to a surface of the cutting table, to change a cutting direction of the cutting blade;

a slide ring provided on the outside of the turning cylinder and capable of following its turning direction;

a lock mechanism provided at a radially outer portion of the turning cylinder so as to lock the slide ring to the cutting head;

a whetstone holding mechanism which is contained in the turning cylinder and holds abrasive surfaces comprising a first abrasive whetstone for grinding a first side of the cutting edge of the cutting blade and a second abrasive whetstone for grinding a second side of the cutting edge of the cutting blade, wherein the abrasive surfaces are held with a space therebetween, a guide shaft, penetrated into the whetstone holding mechanism, for guiding the whetstone holding mechanism linearly, and a change over mechanism, supported by the turning cylinder, for moving the whetstone holding mechanism along the guide shaft, and for changing the whetstone holding mechanism between a standby state and a first side grinding state or a second side grinding state, in the standby state the abrasive surfaces of the first abrasive whetstone and the second abrasive whetstone being away from both sides of the cutting edge, in the first side grinding state the abrasive surface of the first abrasive whetstone being put in contact with the first side of the cutting edge, and in the second side grinding state the abrasive surface of the second abrasive whetstone being put in contact with the second side of the cutting edge;

wherein the orientation of the abrasive surface of the first abrasive whetstone in the standby state is parallel to its orientation in the first side grinding state and the second side grinding state, and the orientation of the abrasive surface of the second abrasive whetstone in the standby state is parallel to its orientation in the first side grinding state and the second side grinding state;

wherein said change over mechanism includes one pair of pivoted cams, which are supported at the rear end side to said slide ring, capable of pinching from both sides of a portion of the whetstone holding mechanism through which said guide shaft penetrates, and in case said lock mechanism locks the slide ring by the turning of said turning cylinder, one of the pivoted cam pushes the whetstone holding mechanism along the guide shaft, so that said change over is done between said standby state and a state in which one of the sides is ground;

the turning cylinder is provided with a rotation ring capable of receiving a rotary drive force from outside and having inner teeth on the inside of the periphery, the whetstone holding mechanism is provided with a gear engaging with the inner teeth of the rotation ring, an engaging mechanism is further provided for displacing the whetstone holding mechanism in oscillation around the guide shaft so as to keep engaging between the gear and the inner teeth of the rotation ring and make moving trajectory of the gear closer to a circular arc, while moving the whetstone holding mechanism along the guide shaft, and the first abrasive whetstone and the second abrasive whetstone rotate by the rotary drive force which transmitted to the gear through the rotation ring from outside of the turning cylinder and grind the cutting blade.

6. The cutting machine according to claim 5, wherein said engaging mechanism includes:

a follower supported by said turning cylinder and fitted to a cam groove, which is provided in said whetstone holding mechanism, and the cam groove includes a curved shape for the whetstone holding mechanism to make an oscillating displacement around the guide shaft while the whetstone holding mechanism moves linearly along the guide shaft.

7. The cutting machine according to claim 5, wherein said slide ring has teeth of a uniform pitch on the outside periphery, and wherein said lock mechanism includes:

a brake provided with inner teeth separated by shifted phase into a plurality steps on the periphery, and biased by spring so as to have different projection amounts at every step, and a drive actuator drives the brake so as to advance and retreat inward of the turning cylinder and locks the slide ring by putting the inner teeth in contact with the teeth of the slide ring so as to engage when the brake advances.

8. The cutting machine according to claim 6, wherein said slide ring has teeth of a uniform pitch on the outside periphery, and wherein said lock mechanism includes:

a brake provided with inner teeth separated by shifted phase into a plurality steps on the periphery, and biased by spring so as to have different projection amounts at every step, and a drive actuator drives the brake so as to advance and retreat inward of the turning cylinder, and locks the slide ring by putting the inner teeth in contact with the teeth of the slide ring so as to engage when the brake advances.

* * * * *